US007468665B2

(12) United States Patent
Grundy

(10) Patent No.: US 7,468,665 B2
(45) Date of Patent: Dec. 23, 2008

(54) ARTICLE HOLDER WITH NOTIFICATION MECHANISM

(75) Inventor: Richard D. Grundy, Miami Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 279 days.

(21) Appl. No.: 11/423,814

(22) Filed: Jun. 13, 2006

(65) Prior Publication Data

US 2007/0284402 A1 Dec. 13, 2007

(51) Int. Cl.
*G08B 13/14* (2006.01)

(52) U.S. Cl. ..... 340/568.1; 340/571; 340/687

(58) Field of Classification Search ..... 340/568.1, 340/571, 686.1
See application file for complete search history.

(56) References Cited

U.S. PATENT DOCUMENTS 3,668,680 A * 6/1972 Spalding et al. ..... 340/568.1
3,760,402 A * 9/1973 Magerle et al. ..... 340/568.8
5,594,419 A * 1/1997 Lo ..... 340/568.1
6,686,841 B1 * 2/2004 Busch et al. ..... 340/571
2003/0150889 A1 * 8/2003 Caroselli et al. ..... 223/120
2004/0204168 A1 10/2004 Laurila
2005/0082319 A1 4/2005 Caroselli et al.

FOREIGN PATENT DOCUMENTS

DE 3738135 C1 * 3/1989
DE 3811154 A1 * 10/1989

* cited by examiner

*Primary Examiner*—George A Bugg

(57) ABSTRACT

An article holder (102) with a notification mechanism is provided for people to hang personal articles. Security alerts and/or incoming call alerts can be provided to a user of the article holder (102). The article holder includes a base (106) that couples to a surface and a hanger (104) that holds articles. The article holder also includes a pressure switch (110) that couples to the base, the pressure switch switching in response to an article being hung on or removed from the hanger. Further, the article holder includes electronic circuitry (112) to detect when the pressure on the hanger changes, which transmits an instant alert in response. The article holder can include additional circuitry (114) that operates in conjunction with a mobile device (302) to alert a user to an incoming call.

15 Claims, 4 Drawing Sheets

ARTICLE HOLDER WITH NOTIFICATION MECHANISM

FIELD OF THE INVENTION

The present invention relates to the field of article holders. In particular, the present invention relates to an article holder with notification mechanisms.

BACKGROUND OF THE INVENTION

Article holders are commonly used to hang personal belongings such as purses, luggage bags, laptop bags and coats in locations such as a private residence and public locations such as offices, restaurants, airports, clubs, discotheques, and so forth. After hanging their belongings on article holders, people often become careless about them, which makes these belongings susceptible to theft. This is especially true in public locations.

Therefore, the owners/management of public locations face a problem in providing security for articles belonging to their customers. A theft can spoil the reputation, popularity and goodwill of a public location. It is therefore in the best interest of the customers, as well as the management of public locations, to have article hangers that provide a high level of security.

In light of the foregoing discussion, there is a need for a system that protects people from having personal articles stolen.

BRIEF DESCRIPTION OF DRAWINGS

The accompanying figures, where like reference numerals refer to identical or functionally similar elements throughout the separate views, and which, together with the detailed description below, are incorporated in and form part of the specification, serve to further illustrate various embodiments and explain various principles and advantages, all in accordance with the present invention.

Figure 1:
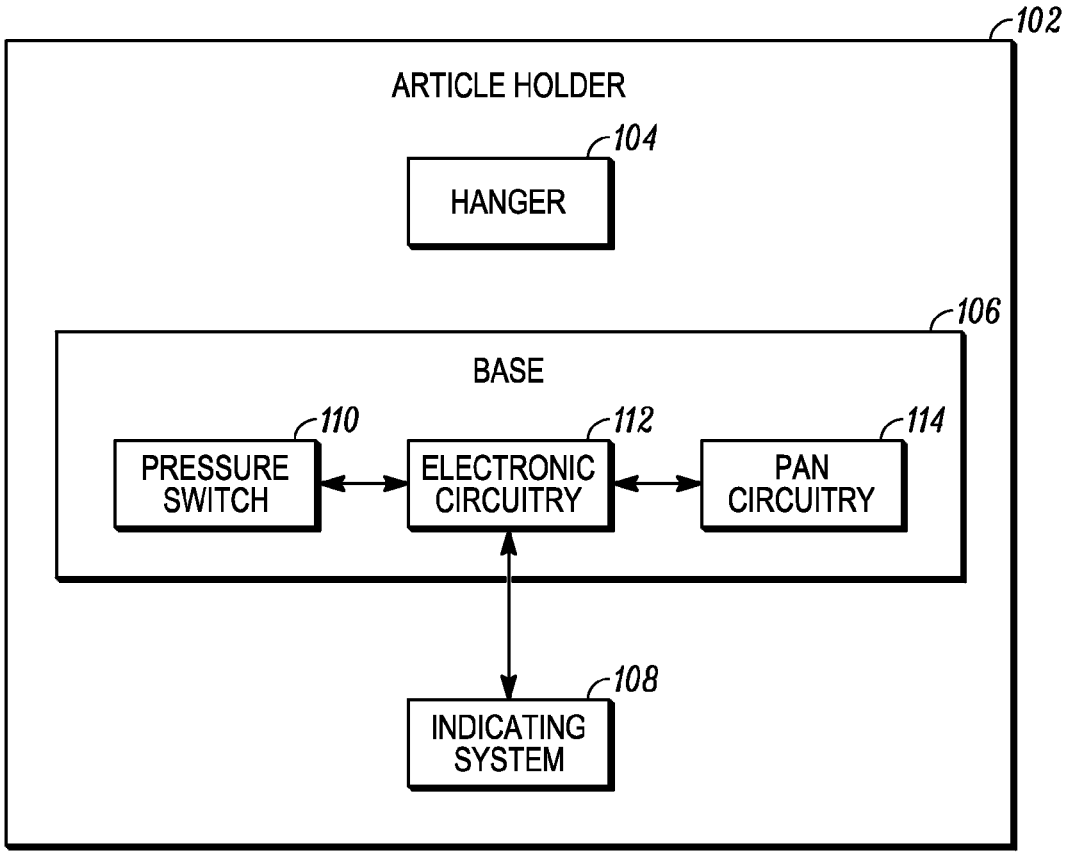
FIG. 1 illustrates a block diagram of an article holder, in accordance with an embodiment of the present invention.

Skilled artisans will appreciate that elements in the figures are illustrated for simplicity and clarity and have not necessarily been drawn to scale. For example, the dimensions of some of the elements in the figures may be exaggerated relative to other elements, to help in improving an understanding of embodiments of the present invention.

DETAILED DESCRIPTION OF DRAWINGS

In an embodiment, an article holder with security mechanism is provided. The article holder includes a base and a hanger coupled to the base for holding articles. The article holder also includes a pressure switch, which is coupled to the base, with the pressure switch switching in response to an article being hung on or removed from the hanger. Further, the article holder includes electronic circuitry, which detects a change in the pressure on the hanger and instantly transmits an alert in response thereto.

In another embodiment, another article holder with a security mechanism and incoming call alert mechanism is provided. The article holder includes a base that is capable of being coupled to a surface and a hanger that is capable of holding an article. The hanger is attached to the base. The article holder also includes a pressure switch for detecting the change of pressure on the hanger. Further, the article holder includes circuitry to communicate over a Personal Area Network (PAN). Furthermore, the article holder includes an indicating system that is capable of transmitting a plurality of alerts.

In yet another embodiment, an article holder with a security mechanism is provided. The article holder includes a hanger having a hook. The hanger secures the article holder to a surface while the hook receives the article. The article holder also includes electronic circuitry that is integrated within the hanger and hook to sense when an article is attached and removed from the hook. Further, the article holder includes an alert feature that is coupled to the hanger to alert a user when the article is removed from the hook.

Before describing in detail the particular article holder with a notification mechanism(s), in accordance with various embodiments of the present invention, it should be observed that the present invention resides primarily in combinations of system elements related to the article holder with a security mechanism. Accordingly, the apparatus components and system elements have been represented, where appropriate, by conventional symbols in the drawings, showing only those specific details that are pertinent for an understanding of the present invention, so as not to obscure the disclosure with details that will be readily apparent to those with ordinary skill in the art, having the benefit of the description herein.

In this document, the terms "comprises," "comprising," or any other variation thereof, are intended to cover a non-exclusive inclusion, such that a process, method, article or apparatus that comprises a list of elements does not include only those elements but may include other elements that are not expressly listed or inherent in such a process, method, article or apparatus. An element proceeded by "comprises . . . a" does not, without more constraints, preclude the existence of additional identical elements in the process, method, article or apparatus that comprises the element. The term "another," as used in this document, is defined as at least a second or more. The terms "includes" and/or "having", as used herein, are defined as comprising.

FIG. 1 illustrates a block diagram of an article holder 102, in accordance with an embodiment of the present invention. Examples of places where the article holder 102 can be used include but are not limited to restaurants, airport waiting lounges, clubs and discotheques. The article holder 102 includes a hanger 104, a base 106, and an indicating system 108. The base 106 further includes a pressure switch 110, electronic circuitry 112, and Personal Area Network (PAN) circuitry 114.

The hanger 104 is capable of holding articles such as purses, briefcases, pocketbooks, luggage bags and laptop bags. The hanger 104 is designed to hold the strap of a carry case. In other words, the article holder disclosed in this invention is capable of holding any inanimate object attached with a strap. The hanger 104 can be made of different materials such as metals, alloys and plastics. For an embodiment of the present invention, the hanger 104 can be a hook for holding the articles. For another embodiment of the present invention, the hanger 104 is a rod for holding the articles. Once an article is hung on the hanger 104 the article holder 102 is powered on. In another embodiment, a user can power on the article holder 102 by depressing a switch.

The hanger 104 is coupled to the base 106, which can be attached to a surface such as a table, chair, wall, and the like. The surface to which the base 106 is attached can be an inclined surface, a horizontal surface or a vertical surface. In an embodiment of the present invention, the base 106 can be a detachable base, which is capable of being temporarily attached to a surface, that is, it can be detached from one surface and then reattached to another surface. The detachable base can be secured to a countertop surface, an armrest or a chair back. In another embodiment of the present invention, the base 106 can be a fixed base. The fixed base is permanently mounted on a surface and cannot be removed once it is attached. The base 106 includes the pressure switch 110 and the electronic circuitry 112. The pressure switch 110 detects a change in pressure in the hanger 104. The pressure switch 110 is internally connected to the hanger 104 and the electronic circuitry 112. When an article is hung on the hanger 104, the article holder 102 is powered on by the pressure switch 110 getting activated. The pressure switch 110 is able to detect when the article is removed from the hanger 104, and switches in response to an article being hung up or removed from the hanger 104.

The electronic circuitry 112 is activated once the article holder 102 is powered on. The electronic circuitry 112 is internally connected to the pressure switch 110 and the indicating system 108. In an embodiment, the electronic circuitry 112 is integrated in the hanger 104. Once activated, the electronic circuitry 112 detects the switching of the pressure switch 110 and hence the removal of the article from the hanger 104. The electronic circuitry 112 conveys the message that the article has been removed to the indicating system 108. The indicating system 108 is an alert feature that is capable of transmitting a variety of alerts, which can be audio alerts, visual alerts and audio-visual alerts. When the indicating system 108 transmits an audio alert, the article holder 102 emits a sound that is loud enough to be heard in a noisy room. The visual alert is transmitted by the indicating system 108 with the help of a display (not shown in the FIG. 1) that is placed on the upper side of the base 106. For one embodiment of the invention, a user can program the indicating system 108 to transmit a particular alert.

For an embodiment of the present invention, the base 106 includes a PAN circuitry 114. The PAN circuitry 114 is capable of communicating with PAN-compatible devices such as mobile phones, laptops and Personal Digital Assistants (PDA's). For example, the PAN circuitry 114 can communicate with a mobile device present in the articles hung on the hanger 104. The PAN circuitry 114 is internally connected to the electronic circuitry 112 and is explained in further detail in conjunction with FIG. 3. For another embodiment of the present invention, the base 106 does not include PAN circuitry 114.

Figure 2:
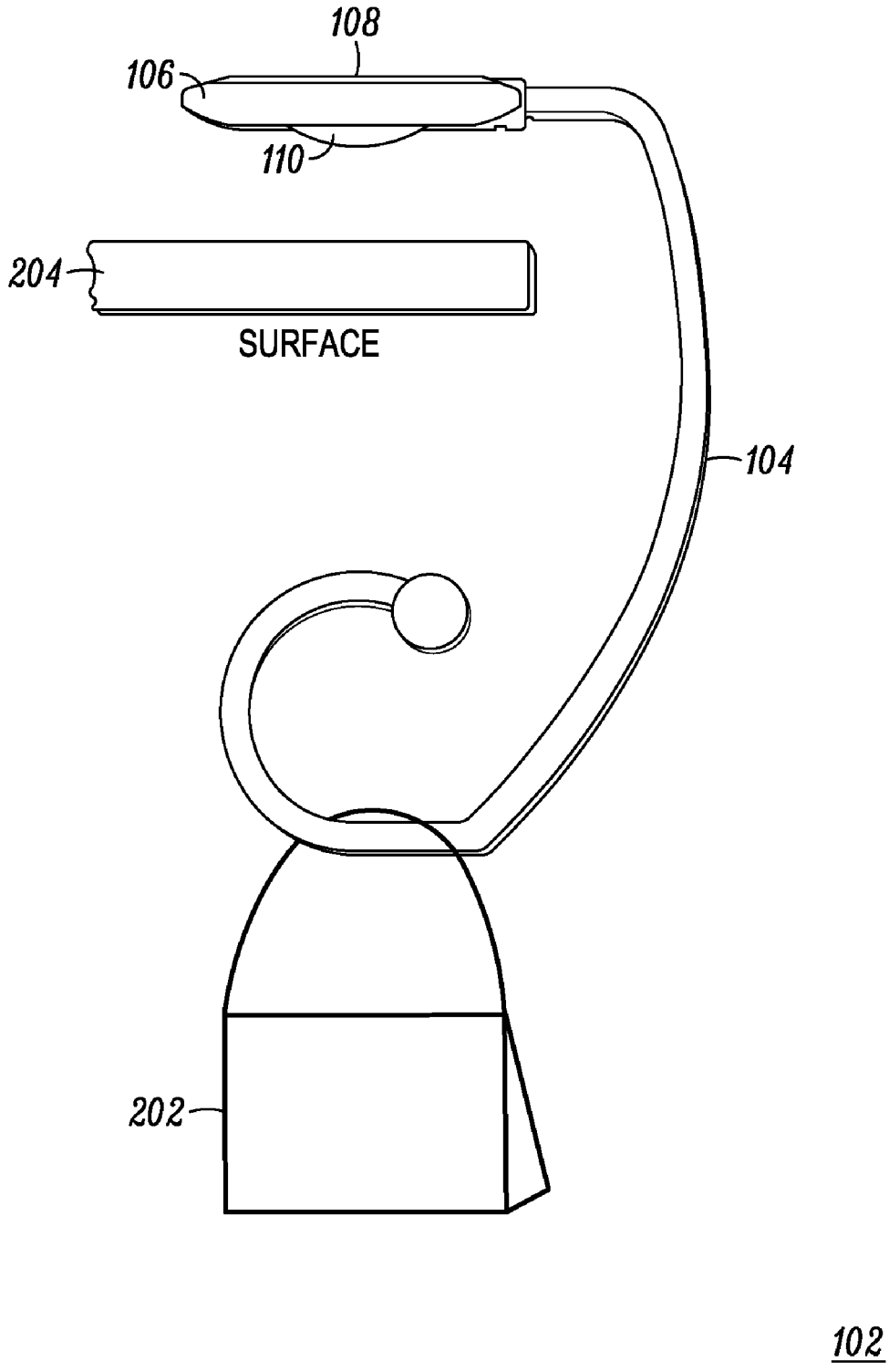
FIG. 2 illustrates an article holder holding an article, in accordance with an embodiment of the present invention.

FIG. 2 illustrates the article holder 102 holding an article 202, in accordance with an embodiment of the present invention. The article holder 102 includes the hanger 104, the base 106, the indicating system 108, and the pressure switch 110. The article holder 102 also includes the electronic circuitry 112 and the indicating system 108 at the base 106. The article holder 102 is coupled to the surface 204 with the help of base 106. The base 106 can be fixed to the surface 204 either permanently or temporarily. The hanger 104 is attached to the base 106 and the article 202, belonging to a user, hangs on it. It will be apparent to one skilled in the art that the article 202 has been shown for exemplary purposes alone. As mentioned earlier, the article holder 102 can hold other articles such as laptop bags, coats and pocketbooks. When the article 202 is hung on the hanger 104, the pressure switch 110 is activated.

Figure 3:
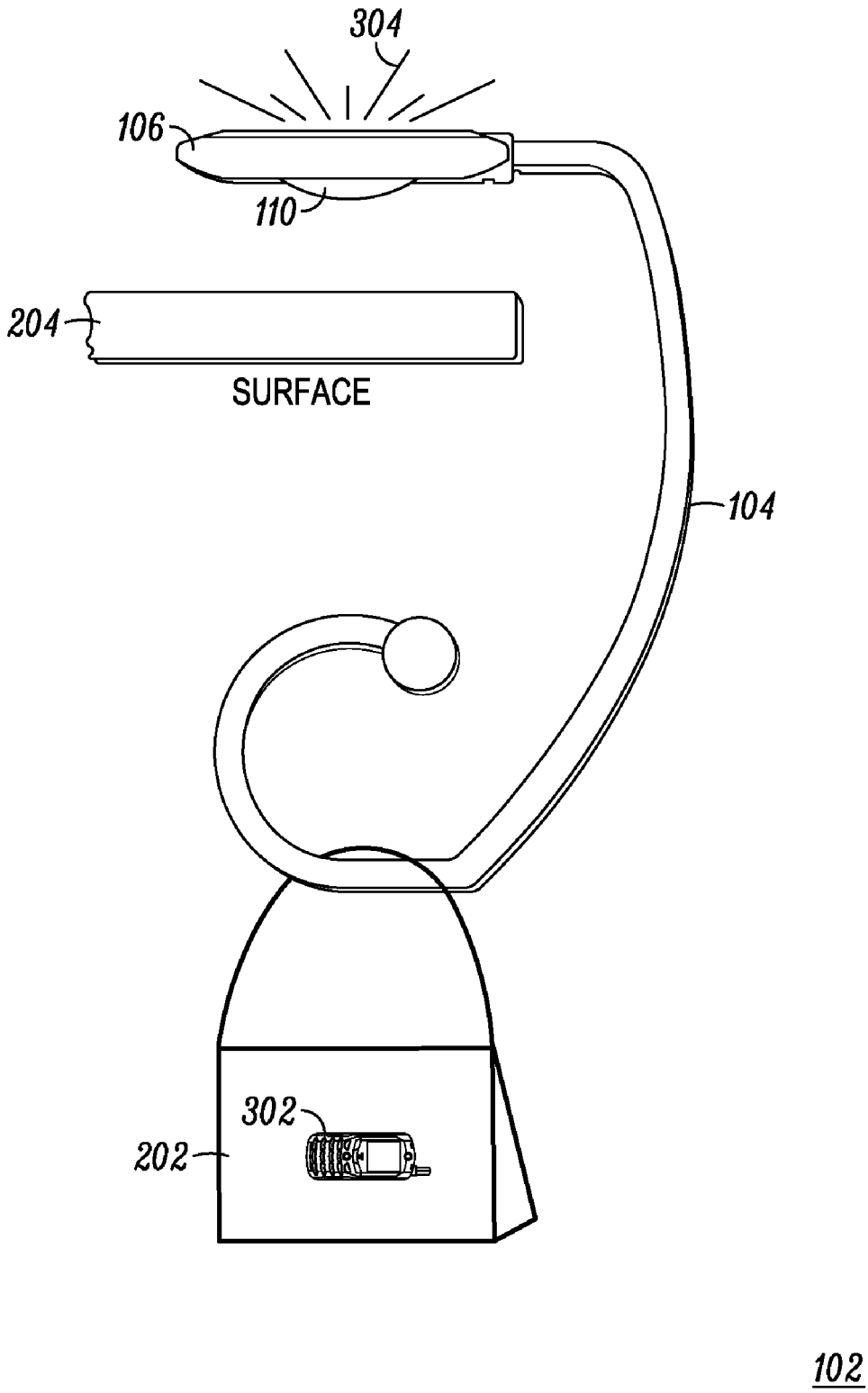
FIG. 3 illustrates a communication between an article holder and a mobile device contained in an article, in accordance with an embodiment of the present invention.

FIG. 3 illustrates a communication between the article holder 102 and a mobile device 302 contained in the article 202, in accordance with an embodiment of the present invention. The mobile device 302 is Personal Area Network (PAN) compatible. When the mobile device 302 receives a phone call or a message that requires the attention of a user, the mobile device 302 communicates with the PAN circuitry 114 of the article holder 102. The PAN circuitry 114 is capable of transmitting and receiving a signal from the electronic circuitry 112. After the PAN circuitry 114 has established communication with the mobile device 302, it signals the electronic circuitry 112. The electronic circuitry 112, in turn, notifies the indicating system 108, which then sends an alert 304 to notify the user. The communication between the mobile device 302 and the PAN circuitry 114 can take place in accordance with Bluetooth, wireless USB, ZigBee or other suitable protocol. FIG. 3 shows the mobile device 302 receiving an incoming call, and the article holder 102 issuing an alert regarding the same to the user. For an embodiment of the invention, the user can program the article holder 102 to issue different alerts for different callers. For example, the user can program the article holder 102 to flash a red light when a call from the user's office is received, and a blue light along with a song when a call from the user's home is received.

Figure 4:
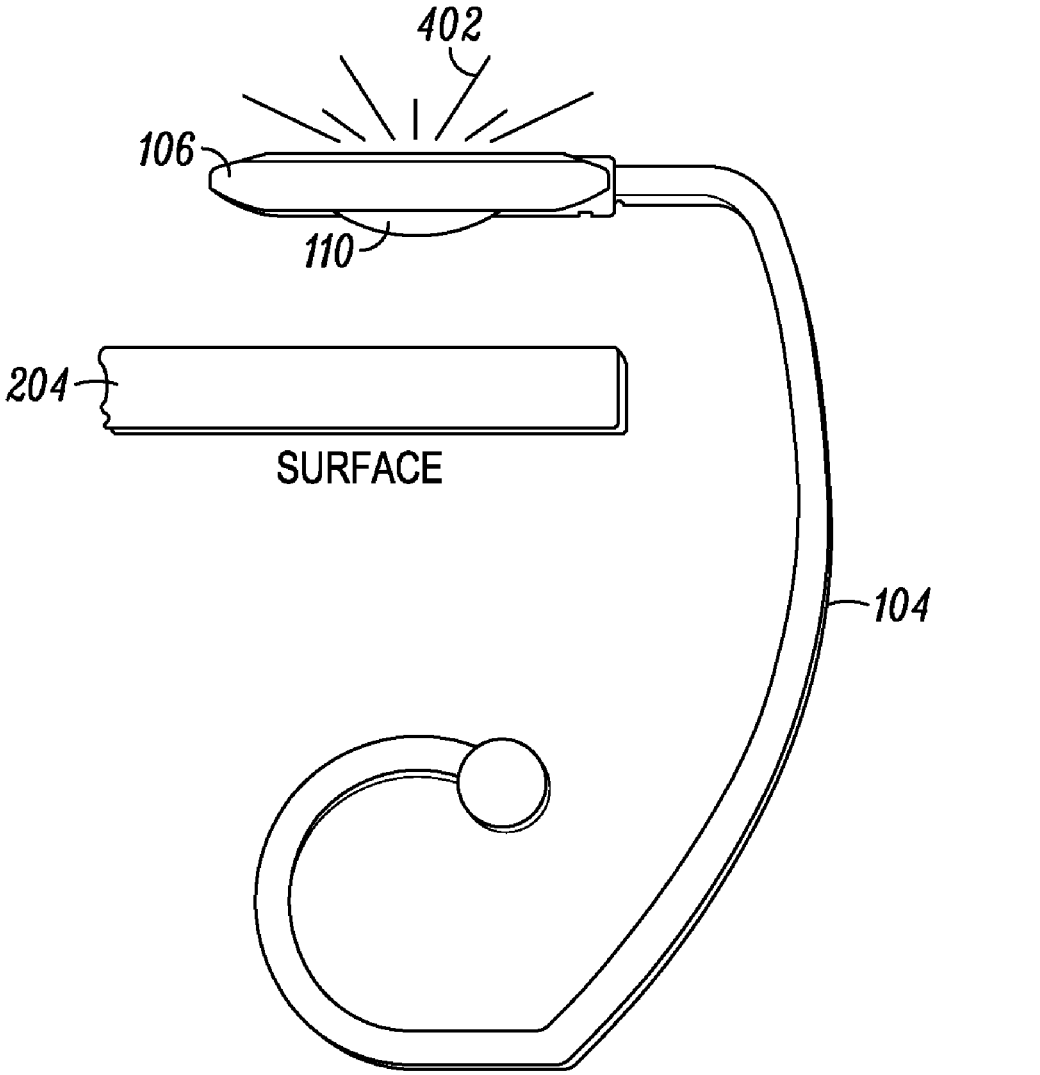
FIG. 4 illustrates operation of an article holder when an article is removed without authorization, in accordance with another embodiment of the present invention.

FIG. 4 illustrates operation of the article holder 102 when the article 202 is removed without authorization, in accordance with another embodiment of the present invention. FIG. 4 shows that the article 202 has been removed from the hanger 104 without authorization. The pressure switch 110 detects the removal of the article 202 and immediately switches in response. The electronic circuitry 112 detects the switching of the pressure switch 110 and transmits a signal to the indicating system 108. The indicating system 108 sends an alert 402 to notify the user about the unauthorized removal of the article 202. As mentioned earlier, the user can program the alert 402 to be an audio alert, a visual alert or an audio-visual alert. The alert 402 can also notify the security personnel present at the place from where the article 202 has been removed. This helps the user and the security personnel protect personal belongings. On the other hand, if the owner wants to remove the purse from the hanger, he/she simply presses the pressure switch button in a predetermined fashion, such as thrice continuously, to deactivate the pressure switch 110. For an alternative embodiment having appropriate data entry means, such as a keypad, the owner need only enter a Personal Identification Number (PIN) in the article holder 102 to power it off.

The present invention provides an article holder with a notification mechanism that can be in the form of a security alert and/or an incoming call alert. The article holder helps users care for personal belongings. Users can hang personal articles on the article holder with increased confidence. The article holder with the security mechanism also helps the owners/management of public places to make their places more secure. Further, the article holder having the incoming call alert feature enables users to leave their mobile phones unattended without the fear of missing important calls.

It will be appreciated that the system for an article holder with notification mechanism(s) described herein may comprise one or more conventional processors and unique stored program instructions that control the one or more processors, to implement, in conjunction with certain non-processor circuits, some, most, or all of the functions of the system described herein. The non-processor circuits may include, but are not limited to, signal drivers, clock circuits, power source circuits and user input devices. As such, these functions may be interpreted as steps of a method to enable users to view a broadcasted media stream differently. Alternatively, some or all the functions could be implemented by a state machine that has no stored program instructions, or in one or more application-specific integrated circuits (ASICs), in which each function or some combinations of certain of the functions are implemented as custom logic. Of course, a combination of the two approaches could also be used. Thus, methods and means for these functions have been described herein.

It is expected that one with ordinary skill, notwithstanding possibly significant effort and many design choices motivated by, for example, available time, current technology and economic considerations, when guided by the concepts and principles disclosed herein, will be readily capable of generating such software instructions, programs and ICs with minimal experimentation.

In the foregoing specification, the invention and its benefits and advantages have been described with reference to specific embodiments. However, one with ordinary skill in the art would appreciate that various modifications and changes can be made without departing from the scope of the present invention, as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage or solution to occur or become more pronounced are not to be construed as critical, required or essential features or elements of any or all the claims. The invention is defined solely by the appended claims, including any amendments made during the pendency of this application, and all equivalents of those claims, as issued.

What is claimed is:

1. An article holder, comprising:

a base;

a hanger for holding the article, the hanger coupled to the base;

a pressure switch coupled to the base, the pressure switch switching in response to an article being hung on and removed from the hanger;

electronic circuitry for detecting when pressure on the hanger changes and transmitting an alert in response thereto;

circuitry for communication over a Personal Area Network (PAN); and wherein the circuitry for communication over the PAN receives a signal from a mobile device contained in the article when the mobile device receives an incoming call, and the electronic circuitry transmitting an alert to a user of the mobile device.

2. The article holder as recited in claim 1 the base being at least one of a detachable base and a fixed base.

3. The article holder as recited in claim 1, the base being capable of attaching to a surface, wherein the surface being at least one of a vertical surface, an inclined surface and a horizontal surface.

4. The article holder as recited in claim 1, wherein the hanger is dimensioned to retain a strap of a carry case.

5. The article holder as recited in claim 1, wherein the pressure switch is located in the base.

6. The article holder as recited in claim 1, wherein the alert is selected from the group comprising an audio alert, a visual alert, and an audio-visual alert.

7. The article holder as recited in claim 1, wherein the communication over the PAN is in accordance with at least one of Bluetooth, wireless USB, and ZigBee.

8. The article holder as recited in claim 1, the circuitry for communication over the PAN being capable of receiving a plurality of distinct electronic signals, each of the plurality of distinct signals corresponding to a distinct caller of the mobile device.

9. An article holder, comprising:

a base for coupling to a surface;

a hanger for holding an article, the hanger being attached to the base;

circuitry for communication over a Personal Area Network (PAN);

an indicating system for transmitting a plurality of alerts; and wherein the circuitry for communication over the PAN receives a signal from a mobile device contained in the article when the mobile device receives an incoming call and the indicating system transmitting the plurality of alerts in response thereto.

10. The article holder as recited in claim 9, the article holder is detachable for temporary coupling by a user to a surface.

11. The article holder as recited in claim 9, wherein the holder is permanently coupled to a surface.

12. The article holder as recited in claim 9, further comprising a pressure switch for detecting a change of pressure on the hanger, wherein the pressure switch is located in the base.

13. The article holder as recited in claim 9, further comprising a pressure switch for detecting a change of pressure on the hanger, wherein the indicating system transmits an alert from the plurality of alerts in response to pressure changes in the pressure switch.

14. The article holder as recited in claim 13, wherein the alert is selected from the group comprising an audio alert, a visual alert, and an audio-visual alert.

15. The article holder as recited in claim 9, wherein the communication over the PAN is in accordance with at least one of Bluetooth standard, Zigbee and wireless USB.

* * * * *